United States Patent [19]

Strate et al.

[11] Patent Number: 4,929,198

[45] Date of Patent: May 29, 1990

[54] CONDUCTOR CONNECTION ASSEMBLY

[75] Inventors: Rüdiger Strate; Rainer Schulze, both of Detmold; Michael Schnatwinkel, Herford; Georg Wagner, Oerlinghausen; Manfred Wilmes; Bernd Haller, both of Detmold; Ernst Herkner, Lemgo; Jörg Diekmann, Bielefeld; Herbert Henning, Detmold, all of Fed. Rep. of Germany

[73] Assignee: C. A. Weidmüller GmbH & Co., Fed. Rep. of Germany

[21] Appl. No.: 327,604

[22] Filed: Mar. 23, 1989

[30] Foreign Application Priority Data

Mar. 26, 1988 [EP] European Pat. Off. ..... 88104911.8

[51] Int. Cl.[5] ..... H01R 4/38

[52] U.S. Cl. ..... 439/709; 439/811; 439/813

[58] Field of Search ..... 439/810–814, 439/801, 709

[56] References Cited

U.S. PATENT DOCUMENTS 4,059,335 11/1977 Simon ..... 439/813

FOREIGN PATENT DOCUMENTS 154179 11/1985 European Pat. Off. .
222039 5/1987 European Pat. Off. .
1200407 9/1958 Fed. Rep. of Germany .
1047901 12/1958 Fed. Rep. of Germany .
1928570 11/1963 Fed. Rep. of Germany .

*Primary Examiner*—Gary F. Paumen
*Attorney, Agent, or Firm*—Laubscher, Presta & Laubscher

[57] ABSTRACT

A conductor connection assembly includes a U-shaped receptacle into which one can insert from above a screw-clamping assembly comprising a screw, a nut threadably connected with the screw, and a wire protection part in the form of a barrel spring or collar connected with the screw. On the nut, there are provided lateral protrusions adapted to fit within corresponding recesses provided in the side walls of the U-shaped receptacle. The screw clamping mechanism and the U-shaped receptacle are locked into position since the collar includes in the upper area thereof lateral shoulder projections which abut against the side edges of the side walls of the U-shaped receptacle upon activation of the screw to displace the clamping mechanism downwardly into the receptacle.

9 Claims, 2 Drawing Sheets

CONDUCTOR CONNECTION ASSEMBLY

BACKGROUND OF THE INVENTION

The present invention relates to a conductor connection assembly including a U-shaped receptacle and a screw-operated clamping mechanism which can be inserted into the receptacle from above. A conductor is arranged within the receptacle and clamped between the receptacle and the clamping mechanism. The clamping mechanism preferably includes a screw, a nut threadably connected with the screw, and a collar such as a barrel spring for protecting the wire conductor.

BRIEF DESCRIPTION OF THE PRIOR ART

Conductor connectors of the type generally described above are well-known in the patented prior art as evidenced by DE-AS 1,200,407, which discloses a clamping terminal for electrical conductors, wherein the conductor is inserted into the terminal. These prior conductors are rather expensive to construct and are also difficult to handle. For example, they include a U-shaped receptacle having a recess into which a nut piece must be screwed, and this must be done by friction adherence while turning the screw. Insertion of the clamping nut mechanism into the U-shaped receptacle is relatively uncontrolled and there is thus the danger that the nut might not fully engage the recess in the receptacle which would mean that there would be an over stress when the screw of the clamping mechanism is tightened. Furthermore, it is necessary to provide on the screw assembly a bearing pin and mounting assembly in order to displace the screw unit. It is also necessary to provide a corresponding receiving slit or groove in the shank of the U-shaped receptacle in order to displace the clamping unit into a position from above that would facilitate the placement of the conductor in order to shift it in combination therewith.

Also known in the art are conductor connectors which fit within the general category of the connectors described above but which are designed in a different manner such as disclosed in European patent No. A2-0154179, European application No. 0222039, and DE-AS 1047901. In these types of devices, the terminal body assembly is shifted as a unit with respect to a bus bar segment with a support for the conductor that is to be connected with the bus bar. In such cases, a terminal system is obtained which has an adequate force-locking effect, but problems can arise during handling when the terminal body as a whole must be shifted or moved over conductors that have been spliced together or which have been improperly inserted at an angle. Moreover, this prior design essentially requires a larger area for the purpose of shifting the terminal bodies. This becomes a significant problem when for example line up terminals such as disclosed in German application No. 1047901 are used. This is because the frequently desired central lateral connections from line up terminal to line up terminal can no longer be accomplished.

Finally, it should be pointed out that in the case of conductor connections, it is known to use barrel springs or spring clips as the wire protection portion and for elastically securing the conductor clamp as disclosed in German patent No. 1,928,570.

The present invention was developed in order to overcome these and other drawbacks of the prior devices by providing a conductor connection assembly which will guarantee the proper insertion of the clamping mechanism from above to secure the conductor to be connected, combined with a simple structural design for the assembly as well as convenient handling thereof.

SUMMARY OF THE INVENTION

Accordingly, it is a primary object of the present invention to provide a conductor connector assembly including a generally U-shaped receptacle adaptable for receiving a conductor for connection with a bus bar and the like. The receptacle includes a pair of upstanding side walls each of which contain at least one recess having a vertically offset portion. A clamping mechanism is connected with the receptacle for clamping the conductor therein. This clamping mechanism includes a screw arranged between and parallel to the receptacle side walls and having a screw axis, a collar connected with the screw and having a configuration for insertion into the receptacle, and a nut threadably connected with the screw. The nut includes at least one lateral projection on and protruding from opposite sides thereof for insertion into the receptacle wall recesses, respectively. Thus, when the clamping mechanism is initially vertically inserted into the receptacle and then laterally displaced in a direction normal to the screw axis without being rotated, the projections from the nut are arranged in the receptacle recess offset portions. When the screw is subseqently tightened, the collar is displaced toward the bottom wall of the receptacle relative to the nut and the receptacle side walls to clamp the conductor against the receptacle bottom wall.

According to a more specific object of the invention, the collar is arranged as a frame around the nut and includes a pair of shoulders protruding laterally therefrom which act as a locking mechanism to lock the nut projections in the receptacle recess offset portions. More particularly, the protrusions or shoulders connected with the collar abut against the side edges of the receptacle side walls when the collar is displaced toward the receptacle bottom wall during tightening of the screw. These shoulders prevent lateral displacement of the clamping mechanism relative to the receptacle.

According to yet another object of the invention, the collar comprises a spring clip having a frame-like configuration and includes opposed free ends defining a passage opening receiving the screw. The ends of the spring clip contain recesses and the screw includes a U-shaped support disk which is received by the recesses in the ends of the spring clip to connect the collar with the screw.

It is another object of the invention to provide a housing formed of insulation material and within which the receptacle is mounted. The housing includes at least one guide slot or groove for receiving and guiding the nut projections into the corresponding receptacle recesses when the collar is inserted into the receptacle.

According to a more specific object of the invention, the housing includes an angle arm pivotably connected therewith for movement between open and closed positions, the angle arm being operable to laterally displace the clamping mechanism relative to the receptacle, thereby inserting the nut projections into the receptacle recess offset portions as the angle arm reaches its closed position.

BRIEF DESCRIPTION OF THE FIGURES

Other objects and advantages of the present invention will become apparent from a study of the following specification when viewed in the light of the accompanying drawing, in which.

DETAILED DESCRIPTION

Figure 1:
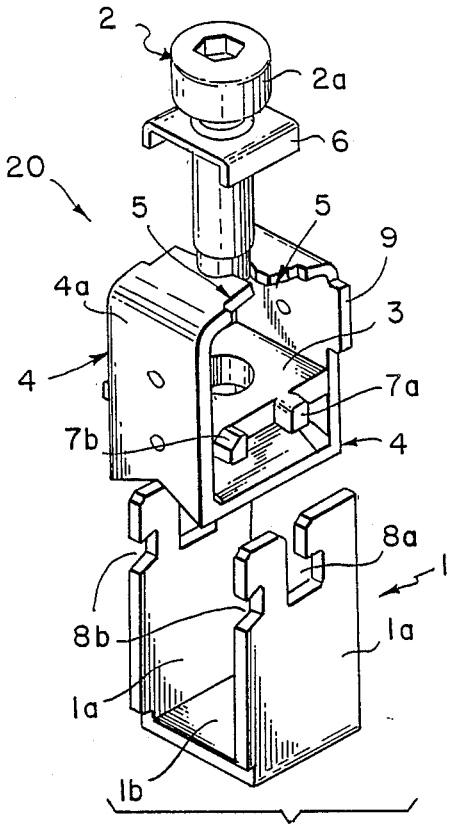
FIG. 1 is an exploded perspective view of the conductor connection assembly according to the invention.

Referring first to FIG. 1, the conductor connection assembly according to the invention includes a U-shaped receptacle 1 having a bottom wall la and a pair of opposed spaced side walls 1*b*. Connected with the receptacle is a clamping assembly 20 including a screw 2, a nut 3, and a wire protection part or collar 4 which in the example illustrated in the drawing is formed of a barrel spring.

Figure 2:
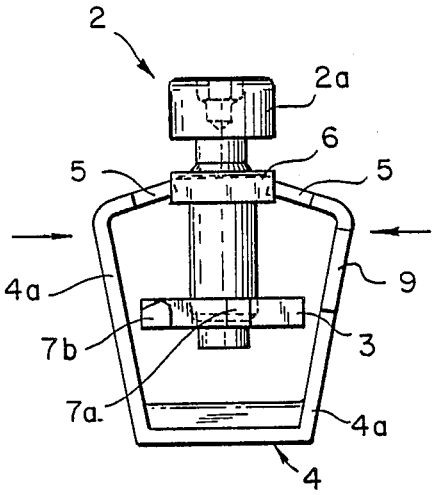
FIG. 2 is a front plan view of the screw-type clamping mechanism illustrating the connection between the collar and the screw.

As shown in FIG. 2, the nut 3 is threadably connected with the lower end of the screw, and the collar 4 is connected with the upper end of the screw adjacent the head portion 2*a* thereof. More particularly, the collar 4 includes end portions which are arranged mutually opposite each other to define an opening for passage of the screw 2. According to a preferred configuration, the ends of the collar 4 include notched recesses 5 on opposite sides thereof for receiving from above a U-shaped support disk 6 arranged on the screw. In accordance with this design, the shanks of the barrel spring type collar 4 cannot be twisted or turned against each other and thus retain their desired configuration. The shank portions 4*a* of the collar, however, can not move inwardly from their position in the direction of the screw shaft when lateral forces applied, whereby undesired friction with a corresponding lateral force and corrosion of the conductor can be avoided. The collar/disk connection arrangement also insures that the head of the screw 2 always retain a straight aligned position relative to the collar.

The clamping assembly shown in FIG. 2 is to be joined with the receptacle 1 by means of an essentially perpendicular movement from above. With the clamping assembly separate from the receptacle, the conductor to be connected with a bus bar or the like is arranged within the receptacle following which the clamping assembly is inserted into the top portion of the receptacle against the conductor. The receptacle side walls 1*a* each contain a recess 8*a* generally centrally arranged in the upper edge of the side wall, these recesses each containing an offset lower portion. The nut 3 of the clamping assembly includes a protrusion or projection 7*a* on opposite sides thereof which are adapted to fit within the recesses 8*a* when the clamping mechanism is inserted into the receptacle. Similarly, the receptacle side walls la also include lateral recesses 8*b* in the side edges thereof for receiving projections 7*b* extending from the nut 3.

Figure 3:
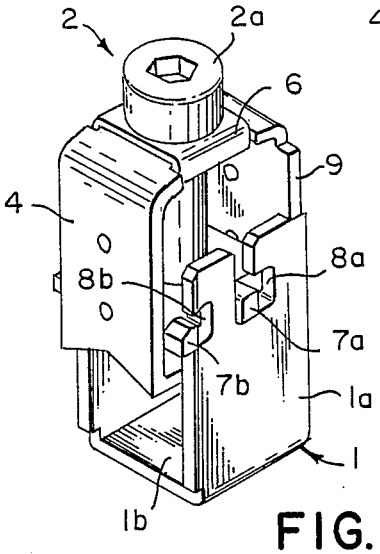
FIGS. 3, 4 and 5 are perspective views illustrating three successive mounting stages for the screw clamping unit with the U-shaped receptacle of the conductor connector assembly according to the invention.
Figure 4:
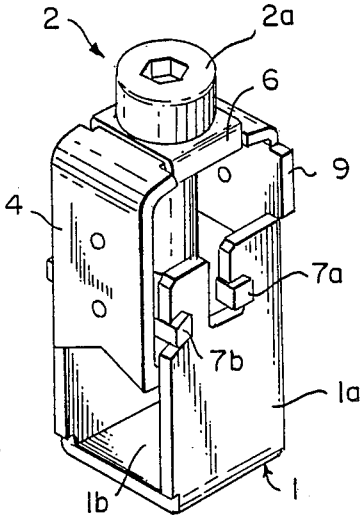

Referring now to FIGS. 3 and 4, it is shown that the clamping assembly is initially inserted into the receptacle 1 with the projections 7*a* passing through the vertical portions of the recesses 8*a* and the receptacle side walls. The clamping assembly is then shifted or displaced laterally as shown in FIG. 4, whereby the protrusions 7*a* from the nut are arranged in the offset portions of the recesses 8*a*, and the protrusions 7*b* are arranged in the lateral recesses 8*b* of the receptacle. With such an arrangement, it is apparent that as the screw 2 is tightened, the collar 4 is displaced downwardly relative to the nut 3 threadably connected with the shaft of the screw, whereby the conductor is clamped between the bottom wall of the U-shaped receptacle and the bottom of the collar 4.

In order to retain the protrusions 7*a*, 7*b* of the nut 3 of the clamping assembly within the corresponding recesses 8*a*, 8*b* in the side walls of the U-shaped receptacle, a locking mechanism is provided on the collar. That is, as shown in FIGS. 1 and 3–5, a pair of shoulders 9 protrude laterally from the edges of the collar 4. These shoulders are arranged to extend externally to abut the side edges side walls of the U-shaped receptacle.

Figure 5:
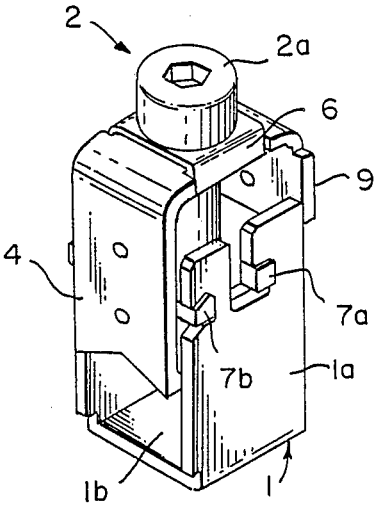

Referring to FIG. 5, it is shown that as the screw 2 is tightened further, the collar is displaced downwardly further into the receptacle 1, with the shoulder portions 9 abutting against the side edges of the upstanding side walls of the receptacle. In the position shown in FIG. 5, the shoulders thus prevent the clamping assembly from being laterally displaced relative to the receptacle. In this fashion, the projections 7*a*, 7*b* are retained in their corresponding recesses 8*a*, 8*b*. With the locking type clamping assembly, it is now possible to join the clamping assembly, with the screw 2 in the open position, with the U-shaped receptacle 1. After only minor rotation of the screw 2, the clamping assembly and the U-shaped receptacle can be linked to each other in a manner in which they can not be separated. The locking shoulders 9 moreover serve to fix the conductor connection assembly in position after the connection of the conductor and thus avoids disconnection of the conductor such as when there is force applied to the conductor wires.

Because the force which is needed for the reliable connection of the conductor passes through the lateral protrusions 7*a*, 7*b* of the nut, it is possible, such as in the case of very strong connection forces, to provide more than just two lateral protrusions per side on the nut. Thus, any number of protrusions and corresponding recesses may be provided between the clamping mechanism and the receptacle wherein increased clamping force is required.

Figure 7:
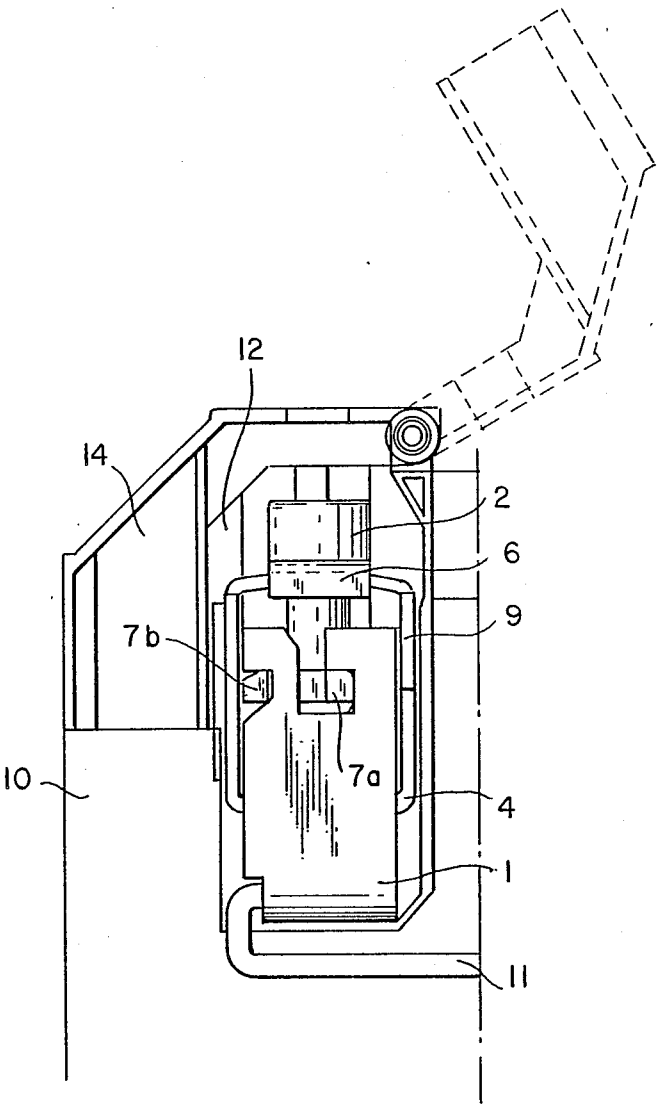
FIG. 7 illustrates the embodiment of FIG. 6 after assembly of the conductor connection.
Figure 6:
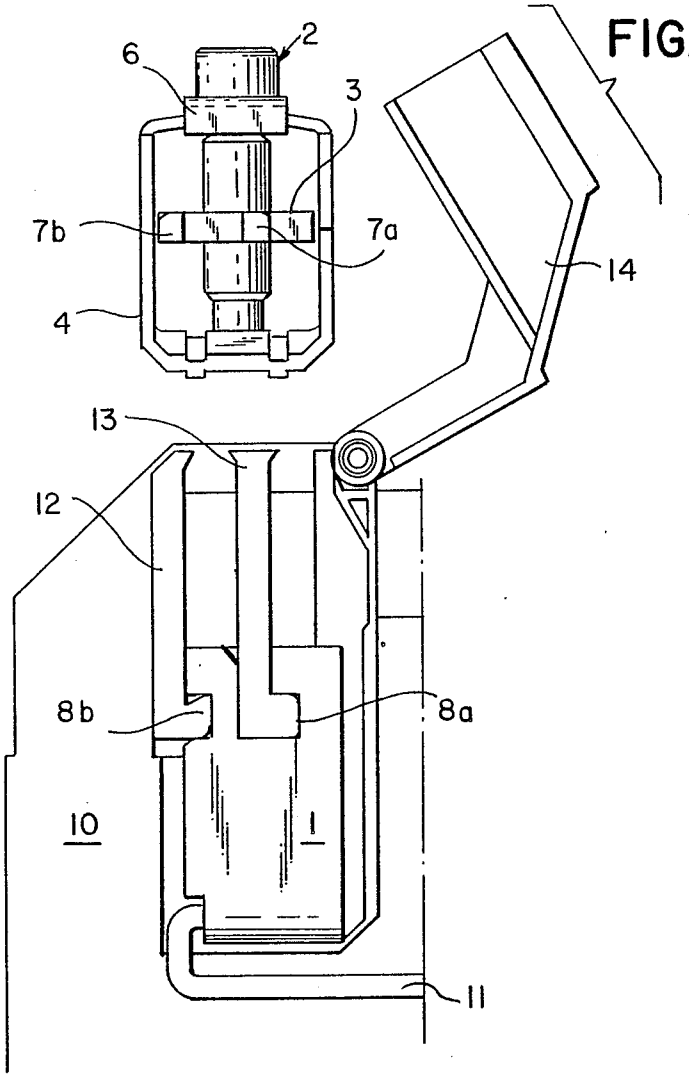
FIG. 6 is a broken side view illustrating a conductor connection assembly arranged in a surrounding housing before the assembly of the U-shaped receptacle and the screw clamping mechanism.

Referring now to FIGS. 6 and 7, there is shown a conductor connection assembly as described with reference to FIGS. 1–5 which is provided in a housing 10 formed of insulation material. Such an arrangement may comprise a line-up terminal, for example. The U-shaped receptacle 1 of the conductor connection assembly is arranged within the housing and contains an opening in the lower portion thereof for receiving a bus bar 11 of the line-up terminal. After insertion of the conductor to be connected, in order for this design to be able to insert the clamping assembly in a simple manner and on target from above into the U-shaped receptacle, there are provided on the walls of the housing 10 guide slots 12, 13 on both sides thereof into which the lateral protrusions 7*a*, 7*b* of the nut may pass. With this arrangement, the guide slots 12, 13 insure the proper insertion of the screw clamping mechanism into the receptacle, since the protrusions 7*a*, 7*b* of the nut of the clamping assembly are guided through the slots 12, 13 of the housing. The guide slots 12, 13 are aligned with the recesses 8*a*, 8*b* in the receptacle side walls so that the projections 7*a*, 7*b* are directed into the receptacle recesses. Following insertion of the clamping mechanism, the assembly is laterally shifted to transfer the projections 7*a*, 7*b* into the offset portions of the corresponding recesses 8*a*, 8*b*.

To assist in the lateral displacement of the clamping mechanism within the receptacle, the housing is provided with an angle lever 14 pivotally connected therewith between open and closed positions. In FIG. 6, the angle lever is shown in its open position, and in FIG. 7, the angle lever is shown in its closed position. As the angle lever is pivoted toward its closed position,.it engages a side of the collar 4 of the clamping mechanism and laterally shifts the entire clamping mechanism, whereby the projections 7*a*, 7*b* are arranged in the offset portions of the recesses 8*a*, 8*b* as the angle lever approaches its closed position as shown in FIG. 7. The connection assembly including the U-shaped receptacle 1 and the screw operated clamping mechanism 20 is then locked together by turning the screw 2. The screw remains accessible by means of a corresponding opening in the housing 10. In place of the angle lever 14, it is apparent that other devices such as slides or eccentric cams may be provided.

With the invention shown in the drawing, the clamping mechanism is easily connected with the receptacle in order to clamp a conductor therein by displacing the screw clamping assembly in one motion essentially perpendicularly from above and then laterally displacing the clamping assembly to insert the protrusions of the nut piece into the offset portions of the recesses in the side walls of the receptacle. With this simple design structure, locking is achieved automatically upon activation of the screw owing to the provision of the shoulder protrusion portions 9 extending from the side edges of the collar. If the screw 2 is turned only slightly, then the screw clamping assembly can neither be inserted nor removed. The locking device moreover simultaneously operates as a position fixing device when the clamping system is stressed as a result of conductor traction or other forces on the conductor.

Providing the collar in the form of a barrel spring enables easy manufacture and assembly since it suffices to simply bend its two ends toward each other about the shank of the screw just below the head portion thereof. This arrangement steadies the position of the overall assembly and also insures proper locking of the projections of the clamping nut within the offset portions of the receptacle recesses. In this manner, when force is applied, the shanks of the barrel spring can no longer move toward the inside from their position in the direction toward the shaft of the screw. This also means that there can not be any undesirable friction movement since no further force is lost during conductor clamping operation. Likewise, it is impossible to damage any possible corrosion protection layers of the conductor. Furthermore, the head of the screw is always retained in a straight placement surface to insure proper alignment. In particular, the two barrel spring shanks can no longer be twisted sideways against each other.

While in accordance with the provisions of the patent statute the preferred forms and embodiments have been illustrated and described, it will be apparent to those of ordinary skill in the art that various changes and modifications may be made without deviating from the inventive concepts set forth above.

What is claimed is:

1. A conductor connector assembly, comprising (a) a generally U-shaped receptacle adapted for receiving a conductor for connection with a bus bar, said receptacle including a bottom wall and a pair of opposed spaced side walls arranged normal to said bottom wall, said side walls each containing at least one recess having a vertically accessible offset portion; and (b) means connected with said receptacle for clamping the conductor therein, said clamping means including (1) a screw arranged between and parallel to said receptacle side walls and having a screw axis;

(2) a collar connected with said screw and having a configuration for insertion into said receptacle; and (3) a nut threadably connected with said screw and including at least one lateral projection on and protruding from opposite sides thereof for insertion into said receptacle wall recesses, respectively, whereby when said clamping means are initially vertically inserted into said receptacle and then laterally displaced in a direction normal to said screw axis without being rotated, said nut projections are arranged in said receptacle recess offset portions, and when said screw is tightened, said collar is displaced toward said receptacle bottom wall relative to said nut and said receptacle side walls to clamp the conductor against said receptacle bottom wall.

2. Apparatus as defined in claim 1, and further comprising means for locking said nut projections in said receptacle recess offset portions.

3. Apparatus as defined in claim 2, wherein said collar surrounds said nut like a frame, said locking means being arranged on said collar and cooperating with said receptacle for locking said projections in said recess offset portions.

4. Apparatus as defined in claim 3, wherein said locking means comprise a pair of shoulders protruding laterally from said collar, said shoulders abutting against the side edges of said receptacle side walls as said collar is displaced toward said receptacle bottom wall during tightening of said screw to prevent lateral displacement of said clamping means relative to said receptacle.

5. Apparatus as defined in claim 1, wherein said receptacle side walls each contain two recesses, one of said recesses being contained in the middle of the upper edge thereof and the other recess being contained in a side edge of said side wall, and further wherein said nut contains two lateral projections on opposite sides thereof.

6. Apparatus as defined in claim 1, wherein said collar comprises a spring clip having a frame-like configuration and including opposed free ends defining a passage opening for receiving said screw, said spring clip ends containing recesses and said screw including a U-shaped support disk, said spring clip recesses receiving the free ends of said support disk to connect said collar with said screw.

7. Apparatus as defined in claim 1, and further comprising a housing formed of insulation material and within which said receptacle is mounted, said housing including at least one guide slot for receiving and guiding said nut projections into said corresponding receptacle recesses when said collar is inserted into said receptacle.

8. Apparatus as defined in claim 7, wherein said housing includes means for laterally displacing said clamping means relative to said receptacle for inserting said nut projections into said receptacle recess offset portions.

9. Apparatus as defined in claim 8, wherein said lateral displacing means comprise an angle arm pivotably connected with said housing between open and closed positions, said angle arm striking said clamping means shortly before it reaches its closed position.

* * * * *